US010697102B2

(12) United States Patent
Heo et al.

(10) Patent No.: US 10,697,102 B2
(45) Date of Patent: Jun. 30, 2020

(54) LAUNDRY TREATMENT APPARATUS

(71) Applicant: LG Electronics Inc., Seoul (KR)

(72) Inventors: Kwangchul Heo, Seoul (KR); Juhan Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 244 days.

(21) Appl. No.: 15/740,937

(22) PCT Filed: Jun. 29, 2016

(86) PCT No.: PCT/KR2016/006966

§ 371 (c)(1),
(2) Date: Dec. 29, 2017

(87) PCT Pub. No.: WO2017/003182

PCT Pub. Date: Jan. 5, 2017

(65) Prior Publication Data

US 2018/0195224 A1 Jul. 12, 2018

(30) Foreign Application Priority Data

Jun. 30, 2015 (KR) ..... 10-2015-0092772

(51) Int. Cl.

| | |
|---|---|
| ***D06F 31/00*** | (2006.01) |
| ***D06F 58/20*** | (2006.01) |
| D06F 39/08 | (2006.01) |
| *D06F 39/12* | (2006.01) |
| *D06F 29/00* | (2006.01) |
| *D06F 33/00* | (2020.01) |
| *D06F 34/28* | (2020.01) |

(Continued)

(52) U.S. Cl.

CPC ..... *D06F 31/00* (2013.01); *D06F 58/203* (2013.01); *D06F 29/005* (2013.01); *D06F 33/00* (2013.01);

(Continued)

(58) Field of Classification Search

CPC ..... D06F 31/00

See application file for complete search history.

(56) References Cited

U.S. PATENT DOCUMENTS

2002/0056293 A1* 5/2002 Kin ..... D06F 39/125 68/12.26

2006/0010934 A1 1/2006 Kim (Continued)

FOREIGN PATENT DOCUMENTS

KR 10-2000-0042591 7/2000

WO WO2008084932 7/2008

OTHER PUBLICATIONS

International Search Report and Written Opinion in International Application No. PCT/KR2016/006966, dated Jun. 29, 2016, 14 pages.

(Continued)

*Primary Examiner* — Jason Y Ko

(74) *Attorney, Agent, or Firm* — Fish & Richardson P.C.

(57) ABSTRACT

A laundry treatment apparatus is disclosed. The laundry treatment apparatus includes a first cabinet, a first drawer drawably disposed in the first cabinet, a first receiver disposed in the first drawer so as to contain laundry therein, a second cabinet disposed under the first cabinet so as to support the first cabinet, a second receiver disposed in the second cabinet so as to contain laundry, a cabinet connecting unit for connecting the first cabinet to the second cabinet, and a cabinet supporting unit for preventing the first cabinet from falling down from the second cabinet when the first drawer is taken out of the first cabinet.

19 Claims, 5 Drawing Sheets

(51) Int. Cl.
*D06F 37/22* (2006.01)
*D06F 58/08* (2006.01)

(52) U.S. Cl.
CPC ..... *D06F 34/28* (2020.02); *D06F 37/22* (2013.01); *D06F 39/088* (2013.01); *D06F 39/125* (2013.01); *D06F 58/08* (2013.01); *D06F 2204/06* (2013.01); *D06F 2204/084* (2013.01); *D06F 2204/10* (2013.01); *D06F 2210/00* (2013.01)

(56) References Cited

U.S. PATENT DOCUMENTS

2008/0110214 A1 5/2008 Snider et al.
2009/0113945 A1 5/2009 Kim et al.
2009/0235551 A1 9/2009 Jo et al.
2010/0011609 A1 1/2010 Park et al.
2010/0064736 A1* 3/2010 Jeong ..... D06F 29/00 68/13 R
2010/0243847 A1* 9/2010 Kucuk ..... A47L 15/4253 248/346.03
2010/0281929 A1 11/2010 Han et al.
2011/0041258 A1* 2/2011 Ko ..... D06F 29/00 8/137

OTHER PUBLICATIONS

Extended European Search Report in European Appln. No. 16818215.2, dated Jan. 28, 2019, 10 pages.

* cited by examiner

[Fig. 1]
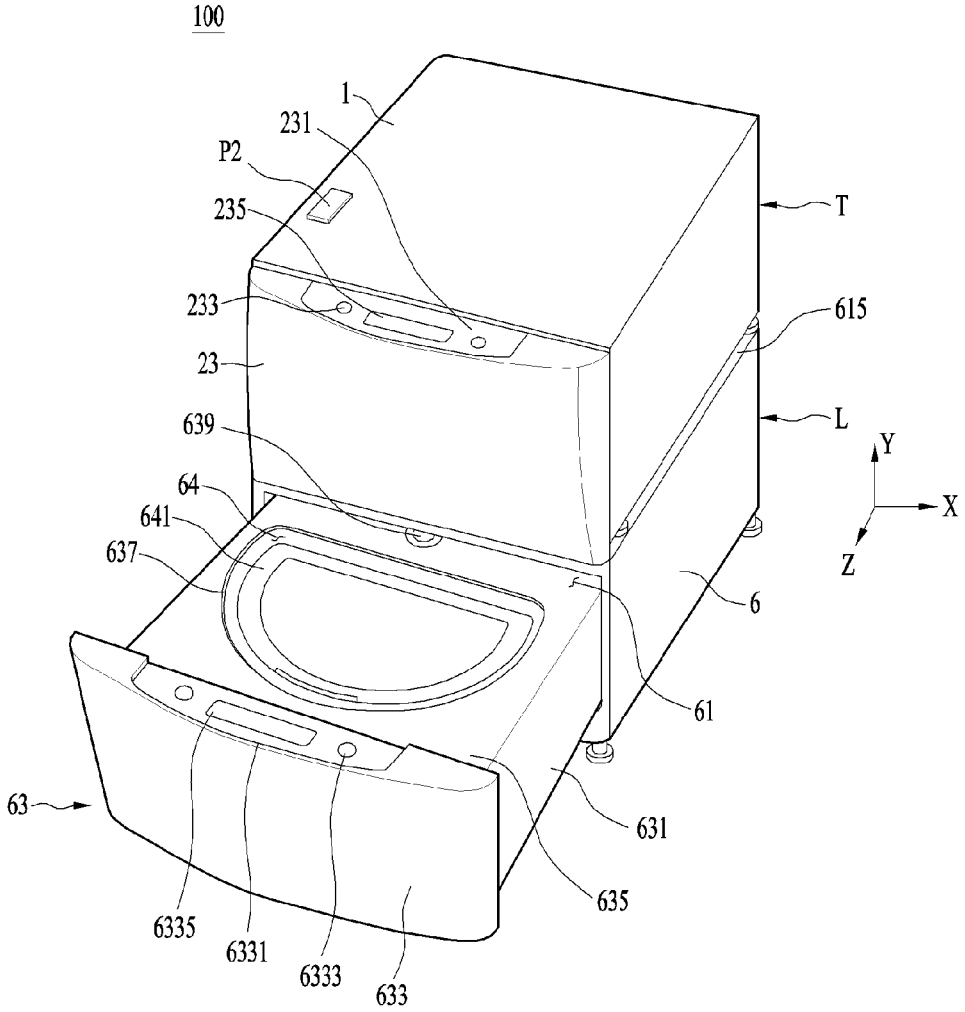

[Fig. 2]
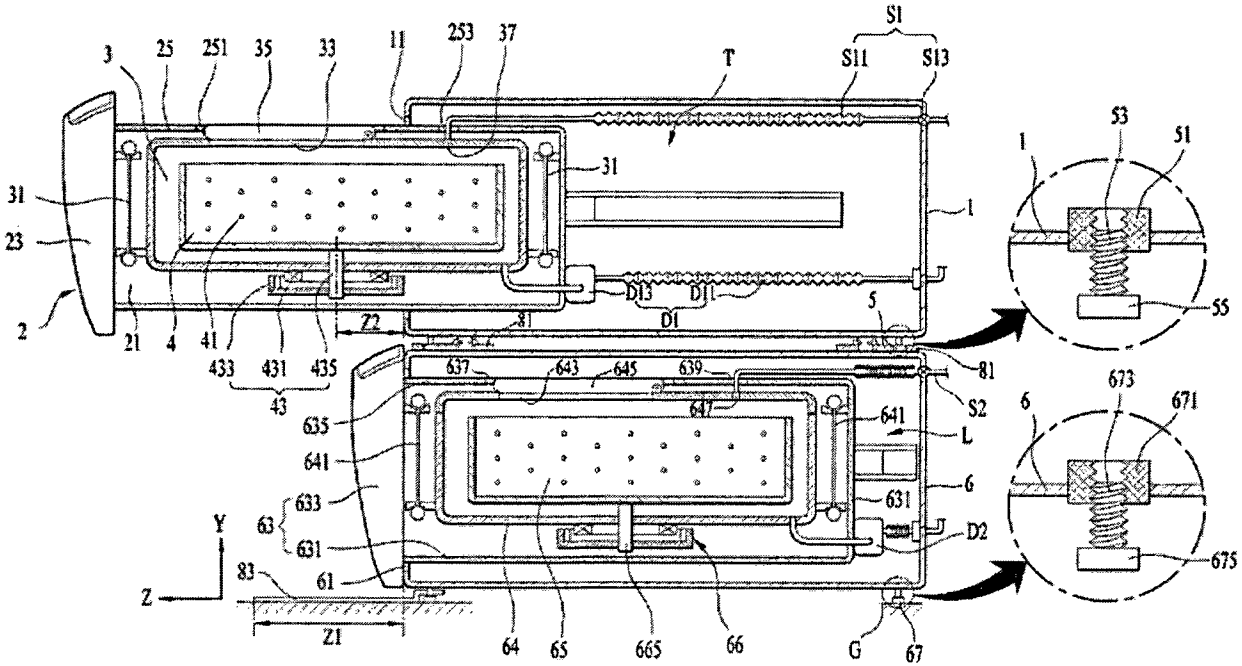

[Fig. 3]
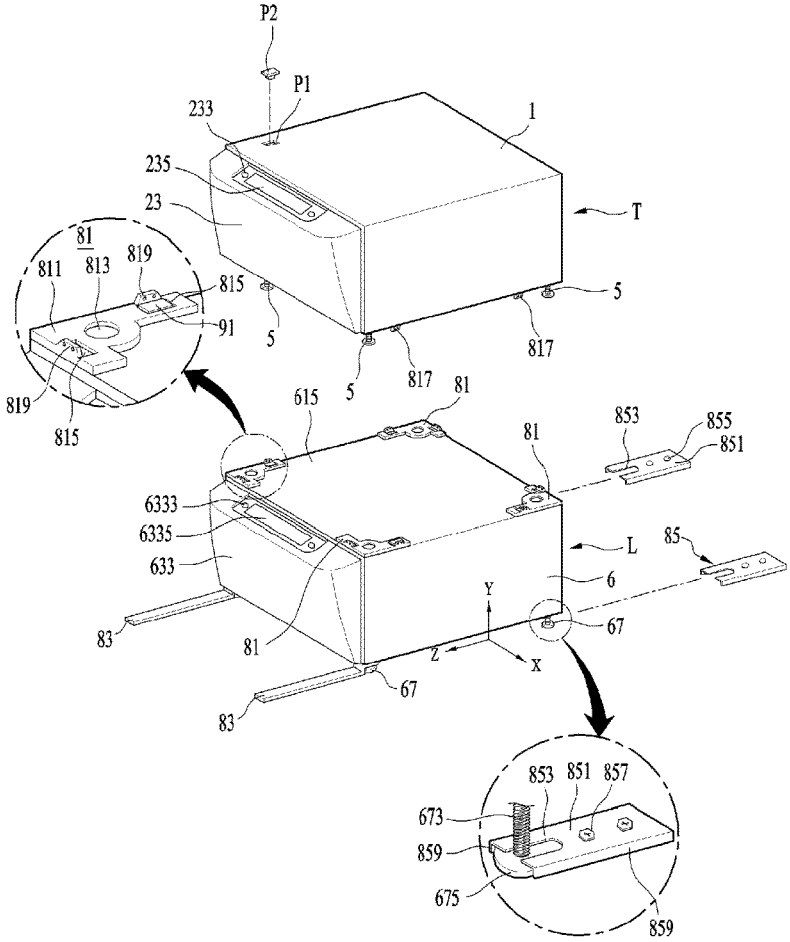
[Fig. 4]
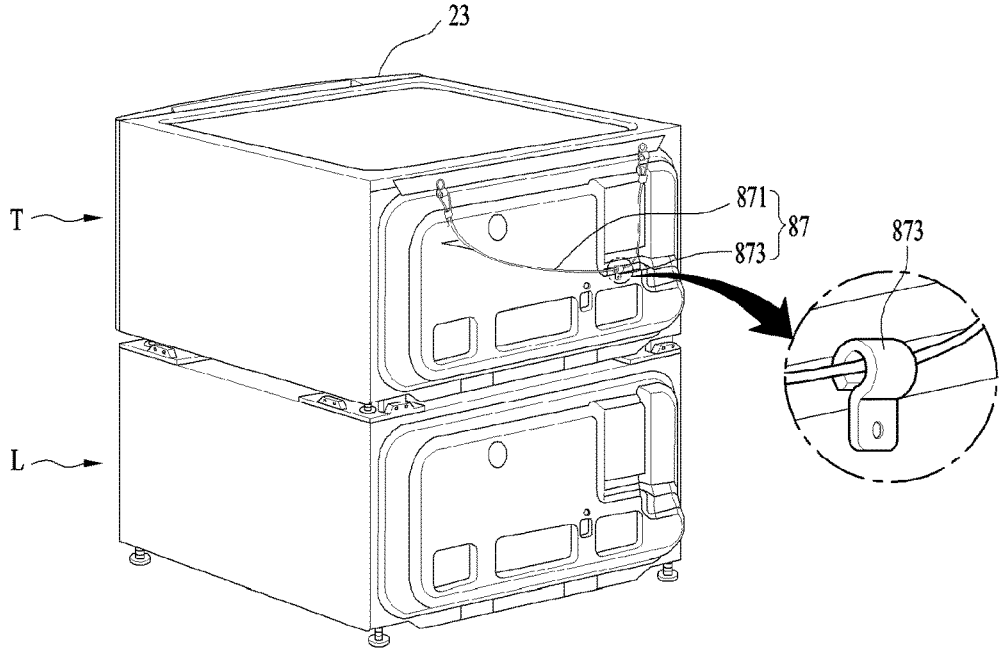

[Fig. 5]
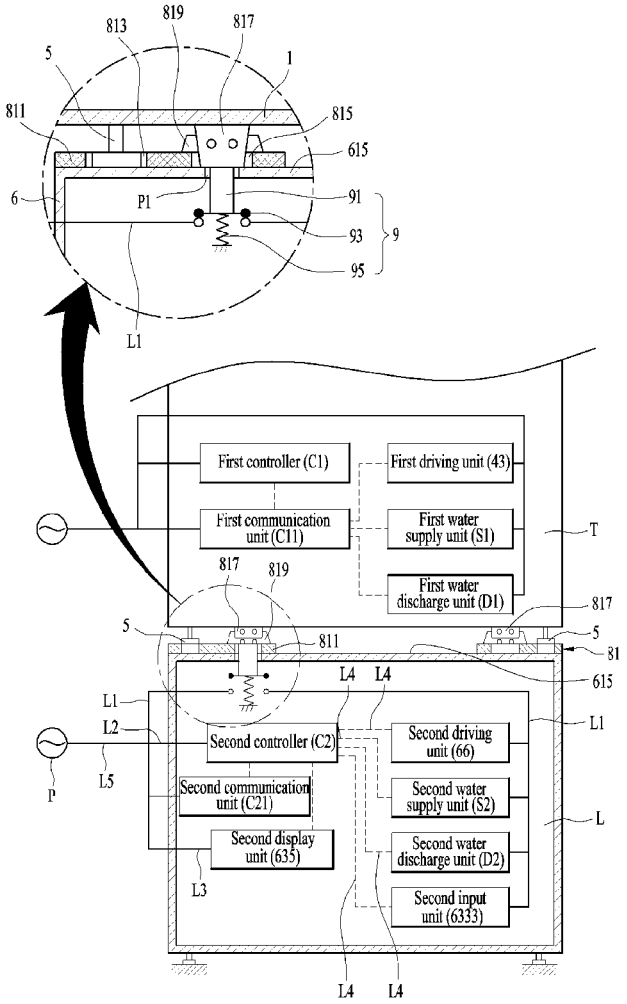

[Fig. 6]
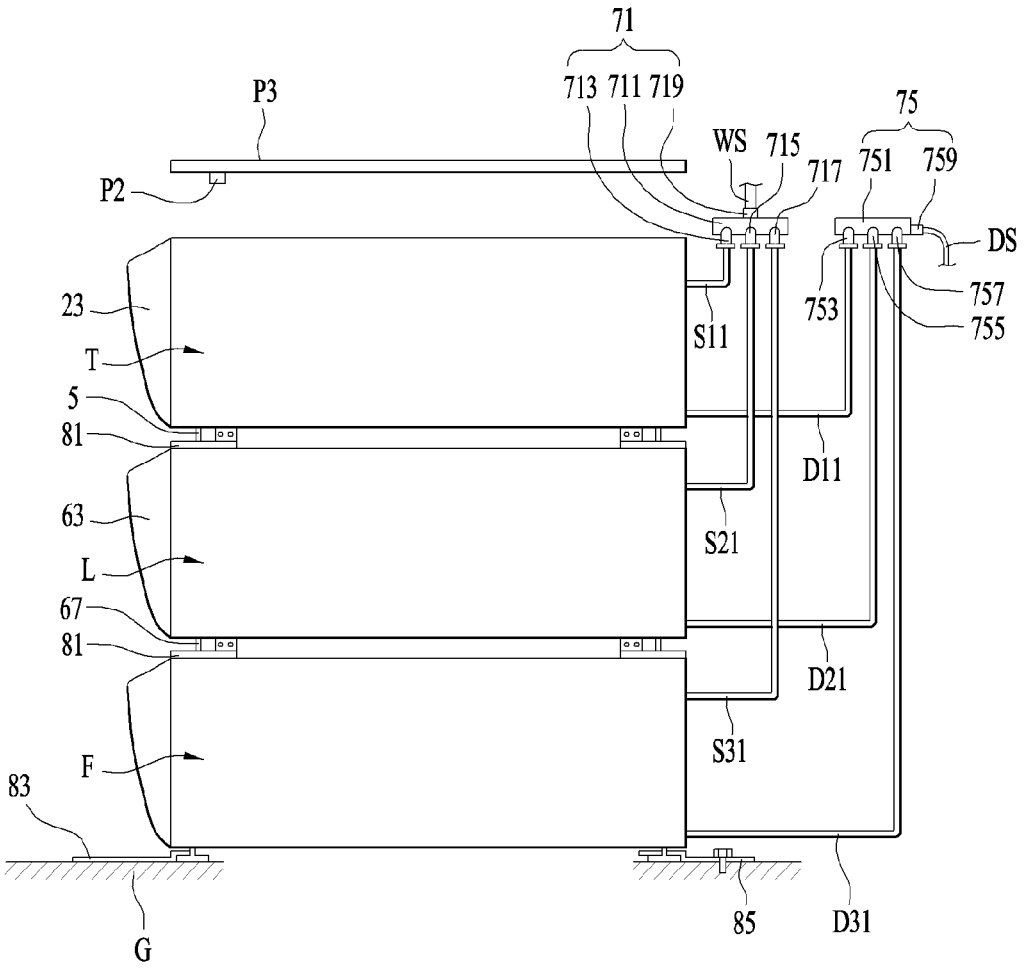

LAUNDRY TREATMENT APPARATUS

CROSS-REFERENCE TO RELATED APPLICATIONS

This application is the National Phase of PCT International Application No. PCT/KR2016/006966, filed on Jun. 29, 2016, which claims priority under 35 U.S.C. 119(a) to Korean Application No. 10-2015-0092772, filed on Jun. 30, 2015, which is hereby incorporated by reference herein in their entirety.

TECHNICAL FIELD

The present invention relates to a laundry treatment apparatus.

BACKGROUND ART

Generally, a laundry treatment apparatus refers to an appliance including an apparatus adapted to perform washing of laundry (objects to be washed and objects to be dried), an apparatus adapted to perform drying of laundry and an apparatus adapted to perform both washing and drying of laundry.

Conventional laundry treatment apparatuses have been classified into a front-loading-type apparatus, in which laundry is introduced into the apparatus through an introduction port formed in the front surface of the apparatus, and a top-loading-type apparatus, in which laundry is introduced into the apparatus through an introduction port formed in the upper surface of the apparatus.

Since conventional laundry treatment apparatus is designed to perform treatment (washing, drying and the like) of a predetermined amount or more of laundry, there is a limitation on the reduction in the volume of the laundry treatment apparatus.

Due to the difficulty in reducing the volume of the laundry treatment apparatus, a user has to buy two laundry treatment apparatuses and has to dispose the two apparatuses on the ground side by side, thereby decreasing the efficiency of use of space in which the laundry treatment apparatuses are mounted.

DISCLOSURE OF INVENTION

Technical Problem

Therefore, the present invention has been made in view of the above problems, and it is an object of the present invention to provide a laundry treatment apparatus in which a plurality of treatment apparatuses, which are adapted to perform various laundry treatment functions (laundry washing, drying and the like), are stacked one on another.

Another object of the present invention is to provide a laundry treatment apparatus in which units for treating laundry are respectively incorporated in receivers, which are drawably provided in cabinets of respective treatment apparatuses.

A further object of the present invention is to provide a laundry treatment apparatus, which is able to prevent an upper treatment apparatus from falling down or falling over during the operation of any of the treatment apparatuses.

Still another object of the present invention is to provide a laundry treatment apparatus composed of a plurality of stacked treatment apparatuses, in which a lower treatment apparatus is operated only when another treatment apparatus is mounted thereon.

Still another object of the present invention is to provide a laundry treatment apparatus composed of a plurality of stacked treatment apparatuses, which includes a water supply connector for supplying water, supplied from a single water supply source, to the plurality of treatment apparatuses.

Still another object of the present invention is to provide a laundry treatment apparatus composed of a plurality of stacked treatment apparatuses, which includes a water discharge connector for guiding washing water, discharged from the plurality of treatment apparatuses, to a single drainpipe.

Solution to Problem

The objects of the present invention can be achieved by providing a laundry treatment apparatus including a first cabinet, a first drawer drawably disposed in the first cabinet, a first receiver disposed in the first drawer so as to contain laundry therein, a second cabinet disposed under the first cabinet so as to support the first cabinet, a second receiver disposed in the second cabinet so as to contain laundry, a cabinet connecting unit for connecting the first cabinet to the second cabinet, and a cabinet supporting unit for preventing the first cabinet from falling down from the second cabinet when the first drawer is taken out of the first cabinet.

The cabinet supporting unit may include a bar or plate, the bar or plate extending from the second cabinet in a direction in which the first drawer is taken out and contacting a surface on which the second cabinet is mounted.

The cabinet supporting unit may include a support body extending from the second cabinet in a direction opposite to a direction in which the first drawer is taken out, and a fastening member for securing the support body to a surface on which the second cabinet is mounted.

The laundry treatment apparatus may further include a stationary body secured to a bottom surface of the second cabinet, and an adjusting body rotatably coupled to the stationary body so as to adjust a height of the second cabinet in accordance with a rotational angle thereof, wherein the support body is detachably coupled to the adjusting body.

The laundry treatment apparatus may further include a contact body provided at the adjusting body and contacting a surface on which the second cabinet is mounted, a flange provided at the support body so as to receive the contact body, and a slit provided in the support body so as to receive the adjusting body.

The cabinet supporting unit may include a wire secured to a rear surface of the first cabinet, and a fastening member for securing the wire to a surface on which the second cabinet is mounted or to a wall defining a space accommodating the second cabinet.

The laundry treatment apparatus may further include a second treatment apparatus driving unit for rotating the second receiver, a second treatment apparatus controller for controlling the second treatment apparatus driving unit, and a second treatment apparatus coupling unit for permitting the second treatment apparatus controller to control the second treatment apparatus driving unit to be operated only when the first treatment apparatus is mounted on an upper surface of the second treatment apparatus.

The second treatment apparatus coupling unit may open or close a circuit for supplying power to the second treatment apparatus driving unit depending on whether the first cabinet is disposed on the second cabinet.

The second treatment apparatus coupling unit may open or close a circuit for connecting the second treatment apparatus controller to the second treatment apparatus driving unit depending on whether the first cabinet is disposed on the second cabinet.

The laundry treatment apparatus may further include a press portion provided at the first cabinet, wherein the second treatment apparatus coupling unit includes a coupling body extending through the upper surface of the second cabinet, the coupling body being pressed by the press portion, and a circuit connector opening or closing a circuit for supplying power to the driving unit or to the control circuit depending on a position of the coupling body.

The cabinet connecting unit may include a first connector provided on a bottom surface of the first cabinet so as to serve as the press portion, and a second connector provided on the second cabinet so as to be coupled to the first connector.

The laundry treatment apparatus may further include a first treatment apparatus driving unit for rotating the first receiver, a first treatment apparatus controller for controlling the first treatment apparatus driving unit, a first treatment apparatus coupling body extending through an upper surface of the first cabinet, a position holder detachably provided at the first cabinet so as to hold a position of the first treatment apparatus coupling body, and a circuit connector for opening or closing a circuit for supplying power to the first treatment apparatus driving unit depending on whether the position holder is disposed on the first cabinet.

The laundry treatment apparatus may further include a first treatment apparatus driving unit for rotating the first receiver, a first treatment apparatus controller for controlling the first treatment apparatus driving unit, a first treatment apparatus coupling body extending through an upper surface of the first cabinet, a position holder detachably provided at the first cabinet so as to hold a position of the first treatment apparatus coupling body, and a circuit connector for opening or closing a control circuit for connecting the first treatment apparatus controller to the first treatment apparatus driving unit depending on whether the position holder is disposed on the first cabinet.

The laundry treatment apparatus may further include a first water supply pipe for supplying washing water to the first receiver, a second water supply pipe for supplying washing water to the second receiver, and a water supply connector for connecting the first and second water supply pipes to a water supply source, wherein the water supply connector includes a water supply connector body detachably coupled to the water supply source, a first attachment pipe provided at the water supply connector body, the first water supply pipe being detachably secured to the first attachment pipe, and a second attachment pipe provided at the water supply connector body, the second water supply pipe being detachably secured to the second attachment pipe.

The laundry treatment apparatus may further include a first water discharge pipe for discharging washing water contained in the first receiver, a second water discharge pipe for discharging washing water contained in the second receiver, and a water discharge connector for connecting the first and second water discharge pipes to a drainpipe connected to an outside of a home, wherein the water discharge connector includes a water discharge connector body detachably coupled to the drainpipe, a first pipe provided at the water discharge connector body, the first water discharge pipe being detachably secured to the water discharge connector body, and a second pipe provided at the water discharge connector body, the second water discharge pipe being detachably secured to the second pipe.

Furthermore, the objects of the present invention can be achieved by providing a laundry treatment apparatus including a cabinet, a first drawer drawably disposed in the cabinet, a first receiver disposed in the first drawer so as to contain laundry therein, a second drawer drawably disposed in the cabinet and disposed under the first drawer, a second receiver disposed in the second drawer so as to contain laundry, and a cabinet supporting unit for preventing the cabinet from falling over when the first drawer is taken out of the cabinet.

The cabinet supporting unit may include a bar or plate, the bar or plate extending from a bottom surface of a second cabinet in a direction in which the first drawer is taken out and contacting a surface on which the cabinet is mounted.

The cabinet supporting unit may include a support body extending from a bottom surface of the cabinet in a direction opposite a direction in which the first drawer is taken out, and a fastening member for securing the support body to a surface on which the cabinet is mounted.

The cabinet supporting unit may include a wire secured to a rear surface of the cabinet, and a fastening member for securing the wire to a surface on which the cabinet is mounted or to a wall defining a space accommodating the cabinet.

Advantageous Effects of Invention

The present invention offers an effect of providing a laundry treatment apparatus in which a plurality of treatment apparatuses, which are adapted to perform various laundry treatment functions (washing, drying and the like of laundry), are stacked one on another.

Furthermore, the present invention offers an effect of providing a laundry treatment apparatus in which units for treating laundry are respectively incorporated in receivers, which are drawably provided in cabinets of respective treatment apparatuses.

In addition, the present invention offers an effect of providing a laundry treatment apparatus, which is able to prevent an upper treatment apparatus from falling down or falling over during the operation of any of the treatment apparatuses.

Furthermore, the present invention offers an effect of providing a laundry treatment apparatus composed of a plurality of stacked treatment apparatuses, in which a lower treatment apparatus is operated only when another treatment apparatus is mounted thereon.

In addition, the present invention offers an effect of providing a laundry treatment apparatus composed of a plurality of stacked treatment apparatuses, which includes a water supply connector for supplying water, supplied from a single water supply source, to the plurality of treatment apparatuses.

Furthermore, the present invention offers an effect of providing a laundry treatment apparatus composed of a plurality of stacked treatment apparatuses, which includes a water discharge connector for guiding washing water, discharged from the plurality of treatment apparatuses, to a single drainpipe.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIGS. 1 and 2 are a perspective view and a cross-sectional view, which illustrate an example of a laundry treatment apparatus according to the present invention;

FIG. 3 is an exploded perspective view illustrating an example of a cabinet supporting unit included in the laundry treatment apparatus according to the present invention;

FIG. 4 is a rear perspective view illustrating another embodiment of the cabinet supporting unit included in the laundry treatment apparatus according to the present invention;

FIG. 5 is a schematic view illustrating a coupling unit included in the laundry treatment apparatus according to the present invention; and FIG. 6 is a side view illustrating a water supply connector and a water discharge connector, which are included in the laundry treatment apparatus according to the present invention.

BEST MODE FOR CARRYING OUT THE INVENTION

Reference will now be made in detail to the preferred embodiments of the present invention, examples of which are illustrated in the accompanying drawings. It should be noted herein that the construction of an apparatus, which will hereinafter be described, and a method of controlling the apparatus are given only for illustrative purposes and the protection scope of the invention is not limited thereto. Wherever possible, the same reference numbers will be used throughout the drawings to refer to the same or like parts.

As illustrated in FIG. 1, the laundry treatment apparatus 100 according to the present invention may include a first treatment apparatus T and a second treatment apparatus L.

The first treatment apparatus T is an apparatus for performing a function of treating laundry, such as washing or drying of laundry (objects to be washed or objects to be dried), and the second treatment apparatus L is disposed under the first treatment apparatus T so as not only to support the first treatment apparatus T but also to perform a function of treating laundry.

As illustrate in FIG. 2, the first treatment apparatus T includes a first cabinet 1, defining the appearance of the treatment apparatus T, a first drawer 2, drawably provided in the first cabinet 1, and a first receiver 3-4, which is disposed in the first drawer 2 so as to define a space required to treat laundry.

The first cabinet 1 is provided with a first open surface 11, through which the first drawer 2 may be put into the first cabinet 1 and may be drawn out of the first cabinet 1. The first cabinet 1 is preferably configured such that the length in the width direction (in the X-axis direction) is greater than the length in the height direction (in the Y-axis direction).

The first drawer 2 includes a first drawer body 21 having the open surface formed in the upper wall, and a first drawer cover 25 provided at the open surface of the first drawer 2.

The first drawer body 21 may be configured to have a hollow hexahedral form, and the first drawer cover 25 may be secured to the first drawer body 21 so as to define the upper surface of the first drawer body 21.

The first drawer body 21 is provided on the front surface thereof with a first drawer panel 23, which serves as means for opening and closing the open surface 11 of the first cabinet 1 and as means for drawing the first drawer body 21 out of the first cabinet 1 and putting the first drawer body 21 into the first cabinet 1.

As illustrated in FIG. 1, the first drawer panel 23 may be provided with a first control panel 231 for controlling the operation of the first treatment apparatus T. The first control panel 231 is provided with a unit (a controller of the first treatment apparatus T) for controlling units for supplying washing water to the first receiver 3-4 and discharging washing water from the first receiver 3-4 (a water supply unit and a water discharge unit), a unit for rotating laundry (a driving unit), units for supplying steam or hot air to laundry (a hot air supply unit and a moisture supply unit) and the like.

The first control panel 231 may be provided with a first input unit 233, for enabling a user to input control commands into the first treatment apparatus T, and a first display unit (a unit for displaying operational information of the first treatment apparatus T) 235, for enabling a user to check control commands input through the first input unit 233 or notifying a user of an execution procedure of the control commands input by the user.

As illustrated in FIG. 2, the first drawer cover 25 may be provided with a first cover-first through hole (first through hole) 251, which is formed through the first drawer cover 25 so that the inside of the first drawer body 21 communicates with the outside, and a first cover-second through hole (a second through hole) 253.

The first receiver 3-4, which is provided in the first drawer 2, may include a first tub 3, which is provided in the first drawer body 21 so as to define a space for containing washing water, and a first drum 4, which is rotatably provided in the first tub 3 so as to contain laundry. The first tub 3 is held in the first drawer 2 by means of a first tub support 31.

The first tub 3 is provided in the upper surface thereof with a first introduction port 33 so that the inside of the first tub 3 communicates with the outside of the first tub 3. The first introduction port 33 is opened and closed by means of the first door 35.

The first door 35 is hingedly provided on the upper wall of the first tub 3 (so as to open and close a portion of the upper surface of the first tub 3). The first door 35 may be rotated toward the outside of the first drawer 2 through the first through hole 251 formed in the first drawer cover 25. Accordingly, a user may put laundry into the first tub 3 by opening the first door 35 after taking the first drawer 2 out of the first cabinet 1.

The first tub 3 is provided in the upper wall thereof with a first inflow hole 37, through which washing water is introduced into the first tub 3. The first inflow hole 37 is connected to the first water supply pipe S11, which will be described later.

The first drum 4 may be configured to have a cylindrical form having an open upper surface. The first drum 4 is rotatable in the first tub 3 by means of a first treatment apparatus driving unit (a first driving unit) 43, which is disposed outside the first tub 3.

The diameter (the length in the X-axis direction) of the first drum 4 is preferably greater than the height (the length in the Y-axis direction) of the first drum 4. The laundry treatment apparatus 100 according to the present invention is characterized in that at least two treatment apparatus T and L are stacked one on another. Since the introduction ports 33 and 643, which are respectively provided in the treatment apparatuses T and L, are disposed parallel to the ground surface G, there is a problem whereby the user's access to the first introduction port 33 becomes difficult as the height of each of the treatment apparatuses is increased. Accordingly, the reason why the diameter of the first drum 4 is greater than the height of the first drum 4 is to minimize the height of the laundry treatment apparatus 100 so as to facilitate the user's access to the introduction port 33, which is positioned at the highest level of the laundry treatment apparatus.

The first driving unit 43 may include a stator 431, which is secured to the first tub 3 so as to create a rotating magnetic field, a rotor 433, which is rotated by the rotating magnetic field, and a first drum-rotating shaft 435, which extends through the first tub 3 to connect the bottom wall of the first drum 4 to the rotor 433. As illustrated in the drawings, the first drum-rotating shaft 435 may be oriented so as to be perpendicular to the bottom surface of the first drawer 2.

The first drawer 2 is preferably constructed such that the first driving unit 43 is not exposed to the outside when the first drawer 2 is taken out of the first cabinet 1. In other words, it is preferable for a first drawer body 21 not to have a hole through which the first driving unit 43 is exposed to the outside.

The first drum 4 is provided in the circumferential wall thereof with first drum through holes 41 through which the inside of the first drum 4 communicates with the inside of the first tub 3.

The reason why the first receiver 3-4 is composed of the first tub 3 and the first drum 4 is to enable the first treatment apparatus T according to the present invention to perform a washing function. Accordingly, in order to enable the first treatment apparatus T to also perform a function of drying laundry in addition to the washing function, there is the need to provide the first cabinet 1 with a hot air supply unit (not shown) for supplying hot air to the first tub 3.

The hot air supply unit (not shown), which is provided in the first treatment apparatus T, may include a circulation duct, for circulating the air in the first tub 3, and a heat exchanger, which is provided in the circulation duct so as to dehumidify and heat the air discharged from the first tub 3.

Alternatively, the first hot air supply unit (not shown) may include a discharge duct for discharging the air in the first tub 3 to the outside of the first cabinet 1, a supply duct for supplying the air outside the first cabinet 1 to the first tub 3, and a heat exchanger for heating the air introduced through the supply duct.

If the first treatment apparatus T is constructed so as to perform only a drying function, unlike the above-described construction, the first tub 3, among the components of the first treatment apparatus T, may be omitted.

In this case, the first treatment apparatus T has to be provided therein with means for rotatably supporting the first drum 4, and the first hot air supply unit has to supply hot air to the first drum 4.

When the first treatment apparatus T is constructed so as to perform a function of washing laundry, the first treatment apparatus T has to be further provided with a first water supply unit S1 and a first water discharge unit D1.

The first water supply unit S1 may include the first water supply pipe S11, connecting the first inflow hole 37 with a water supply source, and a valve S13 for opening and closing the first water supply pipe S11 via the controller (the first controller) C1.

The first water supply pipe S11 extends into the first drawer 25 through the second through hole 253. The first water supply pipe S11 is preferably constructed to have an extendable structure, or is made of a flexible material, in consideration of the moving range of the first drawer 25.

The first water discharge unit D1, which is intended to discharge washing water, contained in the first tub 3, outside the first cabinet 1, may include a first water discharge pipe D11 for guiding the washing water in the first tub 3 to the outside of the first cabinet 1, and a pump D13 (which is controlled by the first controller), which is disposed in the first water discharge pipe D11 so as to discharge the washing water in the first tub 3. The first water discharge pipe is also constructed to have an extendable structure, or is made of a flexible material.

The first treatment apparatus T may be provided on the bottom surface thereof with a first adjusting unit 5 for adjusting the height or horizontal position of the first treatment apparatus. The adjusting unit 5 may include a first stationary body 51 secured to the bottom surface of the first cabinet 1, a first adjusting body 53 rotatably provided in the first stationary body 51, and a first contact body 55, which is provided at the first adjusting body 53 so as to contact the second treatment apparatus L.

The first adjusting body 53 may be embodied as an external thread, and the first stationary body 51 may be embodied as an internal thread with which the external thread is engaged. Here, the first adjusting unit 5 is able to adjust the distance between the first contact body 55 and the first stationary body 51 in accordance with the rotational angle of the first adjusting body 53. The first adjusting unit 5 preferably includes three or more first adjusting units, which are provided on the bottom surface of the first cabinet 1. The first adjusting units 5 enable a worker to adjust the horizontal position of the first cabinet 1 or the height of the first cabinet 1.

The second treatment apparatus L, which is disposed under the first treatment apparatus T, may be constructed so as to perform the same function as the first treatment apparatus T or to perform a function different from that of the first treatment apparatus T.

When the first treatment apparatus T is constructed so as to perform a function of drying laundry, the second treatment apparatus L may be constructed so as to perform a function of washing laundry or to perform both functions of drying and washing laundry.

Meanwhile, when the first treatment apparatus T is constructed so as to perform a function of washing laundry, the second treatment apparatus L may be constructed so as to perform a function of drying laundry or to perform both functions of drying and washing laundry.

Furthermore, when the first treatment apparatus T is constructed so as to perform both a function of washing laundry and a function of drying laundry, the second treatment apparatus L may be constructed so as to perform a function of either drying or washing laundry.

FIG. 2 illustrates an example in which the second treatment apparatus L performs the same function (washing of laundry) as the first treatment apparatus T. In this case, the second treatment apparatus L may include a second cabinet 6, a second drawer 63 drawably provided in the second cabinet 6, and a second receiver 64-65, which is disposed in the second drawer 63 so as to provide a space for accommodating laundry.

As illustrated in FIG. 1, the second cabinet 6 includes a second open surface 61 through which the second drawer 63 is inserted, and the first treatment apparatus T is mounted on the upper surface 615 of the second cabinet 6.

The second drawer 63 may include a second drawer body 631, a second drawer cover 635 defining the upper surface of the second drawer body 631, and a second drawer panel 633 secured to the second drawer body 631.

The second drawer panel 633 may be provided with a second control panel 6331. The second control panel 6331 may be provided with a second input unit 6333 and a second display unit 6335, which are controlled by a second treatment apparatus controller (a second controller). Since the functions of the second control panel 6331, the second input unit 6333 and the second display unit 6335, which are included in the second treatment apparatus L, are the same as those of the first control panel, the first input unit and the first display unit, which are included in the first treatment apparatus T, detailed descriptions thereof are omitted.

The second drawer cover 635 may be provided with a second cover-first through hole (a third through hole) 637 through which the inside of the second drawer 63 communicates with the outside of the second drawer 63, and a second cover-second through hole (a fourth through hole) 639.

When the second treatment apparatus L is constructed so as to perform a function of washing laundry, the second receiver 64-65 may include a second tub 64 for containing washing water, and a second drum 65, which is provided in the second tub 64 so as to contain laundry therein.

As illustrated in FIG. 2, the second tub 64 is held in the second drawer body 631 by means of a second tub support 641. The second tub 64 is provided in the upper wall thereof with a second introduction port 643 and a second inflow hole 647.

The second introduction port 643 is disposed below the third through hole 637, and is opened and closed by means of a second door 645, which is hingedly coupled to the second tub 64.

The second inflow hole 647, which is intended to allow washing water to be introduced into the second tub 64 therethrough, is connected to a second water supply pipe S21, which will be described later.

The second drum 65 is rotatable in the second tub 64 by means of a second treatment apparatus driving unit (a second driving unit) 66. The structures of the second drum 65 and the second driving unit 66 may be identical to those of the first drum 4 and the first driving unit 43 of the first treatment apparatus T. In other words, the second driving unit 66 may also include a stator, a rotor and a second drum-rotating shaft 665 connecting the rotor to the second drum 65.

The second tub 64 receives washing water through a second water supply unit S2, and the washing water contained in the second tub 64 is discharged outside the second cabinet 6 through a second water discharge unit D2.

The structures of the second water supply unit S2 and the second water discharge unit D2 may be the same as those of the first water supply unit S1 and the first water discharge unit D1. In other words, the second water supply unit S2 may include a second water supply pipe S21, connecting the second inflow hole 647 to a water supply source, and a second valve for opening and closing the second water supply pipe S21.

Here, the second water supply pipe S21 extends into the second drawer cover 635 through the fourth through hole 639, and is preferably constructed to have an extendable structure or is made of a flexible material in consideration of the moving range of the second drawer 63.

The second water discharge unit D2 may include a second water discharge pipe D21 for guiding the washing water in the second tub 64 outside the second cabinet 6, and a pump provided in the second water discharge pipe D21. The second water discharge pipe D21 is also preferably constructed to have an extendable structure or is made of a flexible material.

The second cabinet 6 may be provided on the bottom surface thereof with a second adjusting unit 67 for adjusting the horizontal position or the height of the second treatment apparatus L. The second adjusting unit 67 may include a second stationary body 671, secured to the bottom surface of the second cabinet 6, a second adjusting body 673 rotatably coupled to the second stationary body 671, and a second contact body 675, which is provided at the second adjusting body 673 so as to contact a mounting surface (the ground or the like) on which the second treatment apparatus L is mounted.

The structures of the second stationary body 671, the second adjusting body 673 and the second contact body 675 may be the same as those of the first stationary body 51, the first adjusting body 53 and the first contact body 55, which are included in the first adjusting unit 5.

Since the first treatment apparatus T includes the first drawer 2, which is drawable out of the first cabinet 1, there is the possibility of the first treatment apparatus T falling down from the second treatment apparatus L when a user puts laundry into the first receiver 3-4 or takes the laundry out of the first receiver 3-4.

In order to take laundry, the washing or drying of which is completed, out of the second treatment apparatus L, a user has to take the second drawer 63 out of the second cabinet 6. Since the center of gravity of the second treatment apparatus L moves forward as the second drawer 63 is taken out of the second cabinet 6, there may be a problem whereby the rear portion of the second treatment apparatus L is separated from the ground G (the front portion of the second treatment apparatus L collides with the ground).

The problem, which may occur in the second treatment apparatus L, may be solved by positioning the first treatment apparatus T on the upper surface 615 of the second treatment apparatus L. However, the above problem cannot be completely solved only by mounting the first treatment apparatus T on the second treatment apparatus L because the first treatment apparatus T may be removed from the upper surface 615 of the second treatment apparatus L by a user.

Furthermore, when the sum of the length of the first treatment apparatus T and the length of the second treatment apparatus L is greater than the length in the width direction of the second treatment apparatus T, there is the possibility of the entire laundry treatment apparatus 100 falling over when the first drawer 2 is taken out of the first cabinet 1 even though the first treatment apparatus T is positioned on the second treatment apparatus L.

Accordingly, in order to prevent the first treatment apparatus T from falling down from the top of the second treatment apparatus L or the entire laundry treatment apparatus 100 from falling over, the laundry treatment apparatus 100 according to the present invention may further include at least one of a cabinet connecting unit 81, cabinet supporting units 83, 85 and 87, and a coupling unit 9 for permitting the second treatment apparatus L to be operated only when the first treatment apparatus T is mounted on the second treatment apparatus L.

FIGS. 3 and 4 illustrate various examples of the cabinet connecting unit and the cabinet supporting unit.

The cabinet connecting unit 81 may serve to couple the first cabinet 1 to the second cabinet 6.

The cabinet supporting unit may be embodied as at least one of a support (a first support) 83, which is disposed ahead of the second treatment apparatus L so as to support the laundry treatment apparatus 100, a support (a second support) 85, which is disposed behind the second treatment apparatus L so as to support the laundry treatment apparatus 100, and a support (a third support) 87, which is provided on the rear surface of the first treatment apparatus T so as to support the laundry treatment apparatus 100.

The cabinet connecting unit 81 may be constituted by a frame, which has spaces capable of respectively accommodating the first and second cabinets, or may be constituted by brackets, which are respectively coupled to the first and second cabinets. FIG. 3 illustrates the latter case.

As illustrated in FIG. 3, the cabinet connecting unit 81 may include a first connector 817, provided on the bottom surface of the first cabinet 1, and a second connector 819, which is provided on the upper surface 615 of the second cabinet 6 and is coupled to the first connector 817.

The cabinet connecting unit 81 may serve not only to couple the first and second cabinets 1 and 6 to each other but also to hold the position of the first adjusting unit 5. Here, the cabinet connecting unit 81 may further include a body 811, which is secured to the upper surface of the second cabinet 6 and on which the second connector 819 is disposed, and an adjusting unit receiver 813, which receives the first contact body 55 of the first adjusting unit 5.

In order to facilitate coupling between the first connector 817 and the second connector 819, the body 811 may further be provided with a receiver 815 in which the free end of the first connector 817 is received. The receiver 815 may be embodied as a hole formed through the body 811, or may be embodied as a recess formed in the surface of the body 811 so as to be concave.

When the first treatment apparatus T is secured to the second treatment apparatus L by means of the cabinet connecting unit 81, the possibility of the first treatment apparatus T falling down from the top of the second treatment apparatus L is greatly reduced by virtue of the weight of the second treatment apparatus L even when the first drawer 2 is taken out of the first cabinet 1.

In particular, when the second treatment apparatus L is heavier than the first treatment apparatus T (when the first treatment apparatus T is constructed so as to perform a function of drying laundry while the second treatment apparatus L is constructed so as to perform a function of washing laundry or to perform both functions of washing and drying laundry), a problem whereby the entire laundry treatment apparatus 100 falls over (the laundry treatment apparatus is rotated about the second adjusting unit 67, which is provided at the front end of the second cabinet 6) will be solved.

However, when the weight of the first treatment apparatus T is equal to or greater than the weight of the second treatment apparatus L (when laundry is introduced only into the first treatment apparatus T), the cabinet connecting unit 81 can prevent the first treatment apparatus T from falling down from the top of the second treatment apparatus L but cannot prevent the entire laundry treatment apparatus 100 from falling over. The cabinet supporting units 83, 85 and 87 are intended to solve this problem.

The first support unit 83 may be constituted by a plate or bar, which extends from the second adjusting unit 67, provided at the front end of the second cabinet 6, in the direction in which the first drawer 2 is taken out.

The first support 83 may extend from the second cabinet 6 in the direction in which the first drawer 2 is taken out, and may contact a mounting surface on which the second cabinet 6 is mounted (a surface on which the laundry treatment apparatus is mounted, such as the ground).

Although the first support 83 may be detachably coupled to the second adjusting unit 57 provided at the front end of the second cabinet 6, the first support 83 may also be constructed by extending the second contact body 675 of the second adjusting unit 67 in the direction in which the first drawer 2 is taken out.

Here, it is preferable that the distance Z1 (see FIG. 2) between the front surface of the second cabinet 6 and the free end of the first support 83 be longer than the distance Z2 between the front surface of the second cabinet 6 and the first drum-rotating shaft 435. This is because there is a high possibility of the center of gravity of the first drawer 2 being positioned near the first drum-rotating shaft 435.

The second support 85 may include a support body 851, which extends from the rear end of the second cabinet 6 in the direction opposite to the direction in which the first drawer 2 is taken out, a slit 853 formed in the support body 851 so as to receive the second adjusting body 673, and a fastening member 857 for securing the support body 851 to the surface on which the second treatment apparatus L is mounted.

The support body 851 is coupled to the second adjusting unit 67 through the slit 853, and the fastening member 857 is secured to the mounting surface through a through hole 855 formed in the support body 851 so as to secure the support body 851 to the mounting surface.

When the second adjusting unit 67 includes the second contact body 675, the second support 85 may further include flanges 859, which are provided on both lateral sides of the support body 851 and extend in the longitudinal direction (z) of the support body 851.

The flanges 859 are intended to provide a space for receiving the second contact body 675. It is preferable that the distance between the two flanges 859 be greater than the length in the width direction of the second contact body 675 (the length in the X-axis direction) and that the height of each of the flanges 859 be greater than the length in the height direction of the second contact body 675 (the length in the Y-axis direction).

Alternatively, the second support 85 may be constituted only by the support body 851, which is secured to the second contact body 675 of the second adjusting unit and extends in the direction opposite the direction (in the −Z-axis direction) in which the first drawer 2 is taken out, and the fastening member 857 for securing the support body to the surface on which the second cabinet 6 is mounted.

As illustrated in FIG. 4, the third support 87 serves to secure the rear surface of the first treatment apparatus T to a surface defining a space (a wall or the ground) in which the laundry treatment apparatus 100 is installed. The third support 87 may include a wire 871 fixed to the rear surface of the first cabinet 1, and a fastening member 873 for securing the wire 871 to the mounting surface or a wall defining a space in which the laundry treatment apparatus 100 is installed.

By virtue of the cabinet supporting unit, the present invention is able not only to prevent the first treatment apparatus T from falling down from the top of the second treatment apparatus L but also to prevent the laundry treatment apparatus 100 from falling over when the first drawer 2 is taken out of the first cabinet 1.

Although the above description has been disclosed based on the case in which the laundry treatment apparatus 100 according to the present invention includes all of the cabinet connecting unit 81, the first support 83, the second support 85 and the third support 87, the present invention may include only one of the cabinet connecting unit 81, the first support 83, the second support 85 and the third support 87.

Furthermore, the laundry treatment apparatus 100 according to the present invention may include the cabinet connecting unit 81 and one of the first support 83, the second support 85 and the third support 87.

Hereinafter, the coupling unit 9, which serves to allow the second treatment apparatus L to be operated only when the first treatment apparatus T is mounted on the second treatment apparatus L, will be described.

As illustrated in FIG. 5, the coupling unit (a second treatment apparatus coupling unit) 9 may be constructed so as to open and close a first circuit L1, which serve to supply power to the components included in the second treatment apparatus (the components to which power is required to be supplied) C, 66, S2, D2, 6333, 6335 and the like.

The first circuit L1 may be embodied as a circuit for supplying power to the components of the second treatment apparatus L, excluding the second controller C and the second display 6335. In other words, the second controller C may always receive power through a second circuit L2, and the second display unit 6335 may always receive power through a third circuit L3.

FIG. 5 illustrates an example of the coupling unit 9, which closes the first circuit L1 when the first treatment apparatus T is mounted on the upper surface 615 of the second treatment apparatus L and which opens the first circuit L1 when the first treatment apparatus T is separated from the upper surface 615 of the second treatment apparatus L.

The coupling unit 9 may include a coupling body 91, which extends through the upper surface 615 of the second cabinet 6, a circuit connector 93, which is provided at the coupling body 91 so as to open and close the first circuit L1, and an elastic support 95 for biasing the circuit connector 93 away from the first circuit L1.

Here, the first cabinet 1 may further include a press portion (not shown), which presses the coupling body 91 when the first cabinet 1 is mounted on the upper surface of the second cabinet 6. Since the press portion may be constructed to have any structure as long as it can press the coupling body 91 when the first cabinet 1 is mounted on the second cabinet 6, the press portion may be embodied as the first connector 817.

The coupling body 91 extends into the upper surface 615 of the second cabinet 6 through a coupling through hole P1, and the coupling body 91, which is inserted into the coupling through hole P1, may be positioned in the receiver 815 provided at the cabinet connecting unit 81. Accordingly, when the first connector 817 is inserted into the receiver 815 in order to couple the first treatment apparatus T to the second treatment apparatus L, the circuit connector 93 will close the first circuit L1. The coupling unit 9 may include only one coupling unit or a plurality of coupling units provided in the second treatment apparatus L.

Unlike the construction illustrated in FIG. 5, the coupling unit 9 may be configured to open and close a main circuit L5, which is adapted to supply power to all of the components to which power is required to be supplied. In this case, the main circuit L5 may be embodied as a circuit for connecting power P to the first circuit L1, the second circuit L2 and the third circuit L3.

Furthermore, the coupling unit 9 may be configured to open and close a control circuit L4, which is adapted to connect the second controller C2 to the components.

Although FIG. 5 illustrates only the second treatment apparatus coupling unit 9 included in the second treatment apparatus, the first treatment apparatus T may also be provided with a coupling unit (a first treatment apparatus coupling unit), which performs the same function as the second treatment apparatus coupling unit 9, because the first treatment apparatus T may be constructed so as to have the same structure as the second treatment apparatus L.

Specifically, the first treatment apparatus coupling unit may include a first treatment apparatus coupling body, which extends through the upper wall of the first cabinet 1, a circuit connector, which is provided at the first treatment apparatus coupling body so as to open and close a power circuit (a circuit for supplying power to the first treatment apparatus driving unit) or a control circuit (a circuit for connecting the first treatment apparatus controller to the first treatment apparatus driving unit), and an elastic support for biasing the circuit connector.

However, since the first treatment apparatus is not provided thereon with any treatment apparatus, there is the need to provide an additional component for pressing the first treatment apparatus coupling body. To this end, the present invention may further include a position holder P2 (see FIG. 3), which is detachably provided on the upper surface of the first treatment apparatus T so as to press the first treatment apparatus coupling body.

As illustrated in FIG. 3, the cabinet of each treatment apparatus has a coupling unit through hole P1 through which the coupling body 91 extends, and the position holder P2 is fitted into the coupling unit through hole P1 so as to hold the position of the coupling body 91.

Mounting the first treatment apparatus T on the upper surface of the second treatment apparatus L may incur the following adverse effects. Specifically, since the first treatment apparatus T is provided therein with the first drum 4, which is rotated by the first drum-rotating shaft 435, and the second treatment apparatus L is provided therein with the second drum 65, which is rotated by the second drum-rotating shaft 665, there is the concern of the first treatment apparatus T falls over together with the second treatment apparatus L when the first drum 4 and the second drum 65 rotate in the same direction.

When the rotational center of the first drum 4 is different from the rotational center of the second drum 65, there is the possibility of the vibrations generated in the first and second treatment apparatuses T and L becoming intensified during rotation of the drums even though the rotational direction of the first drum 4 is different from the rotational direction of the second drum 65.

In order to solve the above problems, it is preferable that the rotational center of the first drum 4 be aligned with the rotational center of the second drum 65 and at least one of the first controller C1 and the second controller C2 control the rotational directions of the drum-rotating shafts 435 and 665 so as to prevent the first and second drums 4 and 65 from rotating in the same direction.

In order to align the rotational centers of the two drums 4 and 65 with each other, the first drum-rotating shaft 435 and the second drum-rotating shaft 665 are positioned on a single line (on a vertical line), which is perpendicular to the ground.

In order to prevent the first and second drums 4 and 65 from rotating in the same direction, the first controller C1 should be able to communicate with the second controller C2. FIG. 5 illustrates an example in which the respective controllers C1 and C2 communicate with a first communication unit C11 included in the first treatment apparatus T and a second communication unit C21 included in the second treatment apparatus L.

In this case, since one of the first controller C1 and the second controller C2 is able to verify information regarding the rotational direction of the drum, which is sent from the other of the first controller C1 and the second controller C2, it will be possible to prevent the two drums 4 and 65 from rotating in the same direction when the two drums 4 and 65 rotate concurrently.

Although the above embodiments are constructed such that the first treatment apparatus T is provided in the first cabinet 1 and the second treatment apparatus L is provided in the second cabinet 6, the laundry treatment apparatus 100 according to the present invention may alternatively be constructed such that the first and second treatment apparatuses T and L are provided in a single cabinet.

In this case, the laundry treatment apparatus 100 according to the present invention may include a single cabinet defining the appearance of the laundry treatment apparatus, the first drawer drawably provided in the cabinet, the first receiver provided in the first drawer so as to contain laundry, the second drawer, which is disposed under the first drawer and is drawable from the cabinet, the second receiver provided in the second drawer so as to contain laundry, and the cabinet supporting unit for preventing the laundry treatment apparatus (i.e. the cabinet) from falling over when the first drawer is drawn out of the cabinet.

In the case in which the first and second treatment apparatuses are provided in a single cabinet, the cabinet connecting unit, which has been described above, may be omitted. However, the cabinet supporting unit 83, 85 and 87, which are intended to prevent the treatment apparatus from falling over when the first drawer is taken out of the cabinet, may be provided in the laundry treatment apparatus, as in the case illustrated in FIG. 3 or 4.

Here, the cabinet supporting unit may be constituted by a bar or plate, which extends from the bottom surface of the cabinet in the direction in which the first drawer is taken out and which contacts the mounting surface on which the cabinet is mounted.

The cabinet supporting unit may also include a support body, which extends from the bottom surface of the cabinet in the direction opposite the direction in which the first drawer is taken out, and a fastening member for securing the support body to the mounting surface on which the cabinet is mounted.

Furthermore, the cabinet supporting unit may also include a wire fixed to the rear surface of the cabinet, and a fastening member for securing the wire to the mounting surface on which the cabinet is mounted or to a wall defining a space for accommodating the cabinet.

Although the above embodiments illustrate the case in which the laundry treatment apparatus 100 according to the present invention includes only the first treatment apparatus T and the second treatment apparatus L, the laundry treatment apparatus 100 according to the present invention may include three or more treatment apparatuses, which are stacked one on another.

FIG. 6 illustrates an example in which the laundry treatment apparatus 100 according to the present invention includes a third treatment apparatus F, which is disposed at the lowermost level, the second treatment apparatus L secured to the upper surface of the third treatment apparatus F, and the first treatment apparatus T secured to the upper surface of the second treatment apparatus L.

In this case, the third treatment apparatus F may be mounted on a mounting surface such as the ground G by means of at least one of the first support 83 and the second support 85, and at least one of the first, second and third treatment apparatuses may be secured to a wall of an installation space by means of the third support 87 (see FIG. 4).

The second treatment apparatus L is secured to the third treatment apparatus F by means of the cabinet connecting unit 81 provided on the upper surface of the third treatment apparatus, and the first treatment apparatus T is secured to the second treatment apparatus L by means of the cabinet connecting unit 81 provided on the upper surface of the second treatment apparatus L.

When the first, second and third treatment apparatuses are constructed to have the same structure, the coupling body provided on the third treatment apparatus F is pressed by the cabinet connecting unit 81 provided on the second treatment apparatus, and the coupling body 91 provided on the second treatment apparatus L is pressed by the cabinet connecting unit 81 provided on the first treatment apparatus T.

However, since the first treatment apparatus T is not provided with any treatment apparatus thereon, there is a necessity to provide an additional component for pressing the coupling body provided at the first treatment apparatus T. To this end, the present invention may further include the position holder P2, which is detachably provided on the upper surface of the first treatment apparatus T so as to press the coupling body of the first treatment apparatus T.

As illustrated in FIG. 3, the cabinet of each treatment apparatus has the coupling unit through hole P1, through which the coupling body 91 extends, and the position holder P2 is fitted into the coupling unit through hole P1 so as to hold the position of the coupling body 91 and thus close the first circuit.

As illustrated in FIG. 6, when the first treatment apparatus T is provided on the upper surface thereof with a work board P3, which serves to provide a work area, the position holder P2 may project from the lower surface of the work board P3.

In addition, the laundry treatment apparatus 100 according to the present invention, which includes the plurality of stacked treatment apparatuses T, L and F, may further include a water supply connector 71 for connecting a water supply source to water supply pipes of the respective treatment apparatuses, and a water discharge connector 75 for connecting water discharge pipes of the respective treatment apparatuses to a drainpipe DS through which washing water is discharged outside the room.

The water supply connector 71 may include a water supply connector body 711, a supply pipe 719 for connecting the water supply connector body 711 to a water supply source WS, a first attachment pipe 713 for connecting the water supply pipe S11 of the first treatment apparatus T to the water supply connector body 711, a second attachment pipe 715 for connecting the water supply pipe S21 of the second treatment apparatus L to the water supply connector body 711, and a third attachment pipe 717 for connecting the water supply pipe S31 of the third treatment apparatus F to the water supply connector body 711.

The water discharge connector 75 may include a water discharge connector body 751, a connecting pipe 759 for connecting the water discharge connector body 751 to the drainpipe DS, a first pipe 753 for connecting the water discharge pipe D11 of the first treatment apparatus T to the water discharge connector body 751, a second pipe 755 for connecting the water discharge pipe D21 of the second treatment apparatus L to the water discharge connector body 751, and a third pipe 757 for connecting the water discharge pipe D31 of the third treatment apparatus F to the water discharge connector body 751.

MODE FOR THE INVENTION

Various embodiments have been described in the best mode for carrying out the invention.

INDUSTRIAL APPLICABILITY

The present invention provides a laundry treatment apparatus in which a plurality of treatment apparatuses, which are adapted to perform various laundry treatment functions (washing, drying and the like of laundry), are stacked one on another.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A laundry treatment apparatus comprising:
- a first cabinet;
- a first drawer located in the first cabinet and configured to be drawn into and out of the first cabinet;
- a first receiver located in the first drawer and configured to receive laundry therein;
- a second cabinet located under the first cabinet and configured to support the first cabinet;
- a second receiver located in the second cabinet and configured to receive laundry therein;
- a cabinet connector configured to fix the first cabinet to the second cabinet; and
- a cabinet supporter configured to restrict the first cabinet from falling down from the second cabinet when the first drawer is drawn out of the first cabinet,
- wherein the cabinet supporter is configured to contact a surface on which the second cabinet is mounted, and configured to extend from the second cabinet in a direction in which the first drawer is drawn out, and
- wherein a length between a front surface of the first cabinet and a free end of the cabinet supporter is equal to or longer than a length between a front surface of the first cabinet and a center of mass of the first drawer when the first drawer is drawn out of the first cabinet.

2. The laundry treatment apparatus according to claim 1, wherein the cabinet supporter includes a bar or plate, the bar or plate extending from the second cabinet in a direction in which the first drawer is drawn out and contacting a surface on which the second cabinet is mounted.

3. A laundry treatment apparatus comprising:
- a first cabinet;
- a first drawer located in the first cabinet and configured to be drawn into and out of the first cabinet;
- a first receiver located in the first drawer and configured to receive laundry therein;
- a second cabinet located under the first cabinet and configured to support the first cabinet;
- a second receiver located in the second cabinet and configured to receive laundry therein;
- a cabinet connector configured to fix the first cabinet to the second cabinet; and
- a cabinet supporter configured to restrict the first cabinet from falling down from the second cabinet when the first drawer is drawn out of the first cabinet,
- wherein the cabinet supporter comprises:
  - a support body that extends from the second cabinet in a direction opposite to a direction in which the first drawer is drawn out; and
  - a fastening member configured to secure the support body to a surface on which the second cabinet is mounted.

4. The laundry treatment apparatus according to claim 3, further comprising:
- a stationary body secured to a bottom surface of the second cabinet; and
- an adjusting body rotatably coupled to the stationary body and configured to adjust a height of the second cabinet,
- wherein the support body is detachably coupled to the adjusting body.

5. The laundry treatment apparatus according to claim 4, further comprising:
- a contact body provided at the adjusting body and contacting a surface on which the second cabinet is mounted;
- a flange provided at the support body and configured to receive the contact body; and
- a slit provided in the support body and configured to receive the adjusting body.

6. A laundry treatment apparatus comprising:
- a first cabinet;
- a first drawer located in the first cabinet and configured to be drawn into and out of the first cabinet;
- a first receiver located in the first drawer and configured to receive laundry therein;
- a second cabinet located under the first cabinet and configured to support the first cabinet;
- a second receiver located in the second cabinet and configured to receive laundry therein;
- a cabinet connector configured to fix the first cabinet to the second cabinet; and
- a cabinet supporter configured to restrict the first cabinet from falling down from the second cabinet when the first drawer is drawn out of the first cabinet,
- wherein the cabinet supporter comprises:
  - a wire secured to a rear surface of the first cabinet; and
  - a fastening member configured to secure the wire to a surface on which the second cabinet is mounted or to a wall defining a space accommodating the second cabinet.

7. The laundry treatment apparatus according to claim 1, further comprising:
- a second driving unit configured to rotate the second receiver;
- a second controller configured to control the second driving unit; and
- a second coupling unit configured to permit the second controller to control the second driving unit to be operated based on the first cabinet being mounted on an upper surface of the second cabinet.

8. The laundry treatment apparatus according to claim 7, wherein the second coupling unit is configured to open or close a circuit that supplies power to the second driving unit depending on whether the first cabinet is located on the second cabinet.

9. The laundry treatment apparatus according to claim 7, wherein the second coupling unit is configured to open or close a circuit that connects the second controller to the second driving unit depending on whether the first cabinet is located on the second cabinet.

10. The laundry treatment apparatus according to claim 7, further comprising a press portion provided at the first cabinet, wherein the second coupling unit comprises:

a coupling body that extends through the upper surface of the second cabinet, the coupling body being pressed by the press portion; and a circuit connector configured to open or close a circuit that supplies power to the second driving unit or to the second controller depending on a position of the coupling body.

11. The laundry treatment apparatus according to claim 10, wherein the cabinet connector comprises:

a first connector provided on a bottom surface of the first cabinet and configured to serve as the press portion; and a second connector provided on the second cabinet and configured to be coupled to the first connector.

12. The laundry treatment apparatus according to claim 10, further comprising:

a first driving unit configured to rotate the first receiver;

a first controller configured to control the first driving unit;

a first coupling body that extends through an upper surface of the first cabinet;

a position holder detachably provided at the first cabinet and configured to hold a position of the first coupling body; and a circuit connector configured to open or close a circuit that supplies power to the first driving unit depending on whether the position holder is located on the first cabinet.

13. The laundry treatment apparatus according to claim 10, further comprising:

a first driving unit configured to rotate the first receiver;

a first controller configured to control the first driving unit;

a first coupling body that extends through an upper surface of the first cabinet;

a position holder detachably provided at the first cabinet and configured to hold a position of the first coupling body; and a circuit connector configured to open or close a control circuit that connects the first controller to the first driving unit depending on whether the position holder is located on the first cabinet.

14. The laundry treatment apparatus according to claim 1, further comprising:

a first water supply pipe configured to supply washing water to the first receiver;

a second water supply pipe configured to supply washing water to the second receiver; and a water supply connector configured to connect the first and second water supply pipes to a water supply source, wherein the water supply connector comprises:

a water supply connector body detachably coupled to the water supply source;

a first attachment pipe provided at the water supply connector body, the first water supply pipe being detachably secured to the first attachment pipe; and a second attachment pipe provided at the water supply connector body, the second water supply pipe being detachably secured to the second attachment pipe.

15. The laundry treatment apparatus according to claim 1, further comprising:

a first water discharge pipe configured to discharge washing water from the first receiver;

a second water discharge pipe configured to discharge washing water from the second receiver; and a water discharge connector configured to connect the first and second water discharge pipes to a drainpipe connected to an outside of a property, wherein the water discharge connector comprises:

a water discharge connector body detachably coupled to the drainpipe;

a first pipe provided at the water discharge connector body, the first water discharge pipe being detachably secured to the first pipe; and a second pipe provided at the water discharge connector body, the second water discharge pipe being detachably secured to the second pipe.

16. A laundry treatment apparatus comprising:

a cabinet;

a first drawer located in the cabinet and configured to be drawn into and out of the cabinet;

a first receiver located in the first drawer and configured to receive laundry therein;

a second drawer that is located in the cabinet, that is arranged under the first drawer, and that is configured to be drawn into and out of the cabinet;

a second receiver located in the second drawer and configured to receive laundry therein; and a cabinet supporter configured to restrict the cabinet from falling down when the first drawer is drawn out of the cabinet, wherein the cabinet supporter is configured to contact a surface on which the cabinet is mounted, and configured to extend from the cabinet in a direction in which the first drawer is drawn out, and wherein a length between a front surface of the cabinet and a free end of the cabinet supporter is equal to or longer than a length between a front surface of the cabinet and a center of mass of the first drawer when the first drawer is drawn out of the cabinet.

17. The laundry treatment apparatus according to claim 16, wherein the cabinet supporter includes a bar or plate, the bar or plate extending from a bottom surface of a second cabinet in a direction in which the first drawer is drawn out and contacting a surface on which the cabinet is mounted.

18. A laundry treatment apparatus comprising:

a cabinet;

a first drawer located in the cabinet and configured to be drawn into and out of the cabinet;

a first receiver located in the first drawer and configured to receive laundry therein;

a second drawer that is located in the cabinet, that is arranged under the first drawer, and that is configured to be drawn into and out of the cabinet;

a second receiver located in the second drawer and configured to receive laundry therein; and a cabinet supporter configured to restrict the cabinet from falling down when the first drawer is drawn out of the cabinet, wherein the cabinet supporter comprises:

a support body that extends from a bottom surface of the cabinet in a direction opposite a direction in which the first drawer is drawn out; and a fastening member configured to secure the support body to a surface on which the cabinet is mounted.

19. A laundry treatment apparatus comprising:

a cabinet;

a first drawer located in the cabinet and configured to be drawn into and out of the cabinet;

a first receiver located in the first drawer and configured to receive laundry therein;

a second drawer that is located in the cabinet, that is arranged under the first drawer, and that is configured to be drawn into and out of the cabinet;

a second receiver located in the second drawer and configured to receive laundry therein; and a cabinet supporter configured to restrict the cabinet from falling down when the first drawer is drawn out of the cabinet, wherein the cabinet supporter comprises:

a wire secured to a rear surface of the cabinet; and a fastening member configured to secure the wire to a surface on which the cabinet is mounted or to a wall defining a space accommodating the cabinet.

* * * * *